US009133595B2

(12) United States Patent
Wilson et al.

(10) Patent No.: US 9,133,595 B2
(45) Date of Patent: Sep. 15, 2015

(54) BENT BLADE SCREW GROUND ANCHOR

(71) Applicant: Hubbell Incorporated, Shelton, CT (US)

(72) Inventors: Jonathan D. Wilson, Columbia, MO (US); Daniel V. Hamilton, Centralia, MO (US); Joseph J. Lurkins, Columbia, MO (US); Kelly S. Hawkins, Centralia, MO (US); Gary L. Seider, Centralia, MO (US); William D. Kirk, Columbia, MO (US)

(73) Assignee: HUBBELL INCORPORATED, Shelton, CT (US)

( * ) Notice: Subject to any disclaimer, the term of this patent is extended or adjusted under 35 U.S.C. 154(b) by 0 days.

(21) Appl. No.: 14/095,407

(22) Filed: Dec. 3, 2013

(65) Prior Publication Data

US 2015/0152620 A1 Jun. 4, 2015

(51) Int. Cl.
*E02D 7/14* (2006.01)
*E02D 5/80* (2006.01)

(52) U.S. Cl.
CPC ..... *E02D 5/801* (2013.01); *E02D 5/803* (2013.01)

(58) Field of Classification Search
USPC ..... 52/155, 157, 153; 405/253, 252.1
See application file for complete search history.

(56) References Cited

U.S. PATENT DOCUMENTS

| | | | | |
|---|---|---|---|---|
| 137,744 | A | | 4/1873 | West |
| 269,548 | A | | 12/1882 | Stephenson |
| 1,270,092 | A | | 6/1918 | Armstrong |
| 3,043,383 | A | * | 7/1962 | Newbold ..... 175/383 |
| 3,148,739 | A | | 9/1964 | Mattingly et al. |
| 3,444,940 | A | | 5/1969 | Thomas et al. |
| 4,334,392 | A | | 6/1982 | Dziedzic |
| 4,467,575 | A | | 8/1984 | Dziedzic |
| 4,793,740 | A | | 12/1988 | Schellhorn |
| 4,979,341 | A | | 12/1990 | Norman et al. |
| 4,981,000 | A | | 1/1991 | Hamilton et al. |
| 5,145,286 | A | | 9/1992 | Summers |
| 5,408,788 | A | * | 4/1995 | Hamilton et al. ..... 52/157 |
| 5,575,122 | A | * | 11/1996 | Hamilton et al. ..... 52/157 |
| 6,394,704 | B1 | | 5/2002 | Saeki et al. |
| 6,494,643 | B1 | | 12/2002 | Thurner |
| 7,377,723 | B2 | | 5/2008 | Nolan |
| 2012/0195691 | A1 | | 8/2012 | Dolly et al. |
| 2012/0205161 | A1 | | 8/2012 | Stimpfle-Ziegler et al. |

* cited by examiner

*Primary Examiner* — Brian Glessner
*Assistant Examiner* — Paola Agudelo
(74) *Attorney, Agent, or Firm* — Roylance, Abrams, Berdo & Goodman, L.L.P.

(57) ABSTRACT

A ground anchor is provided for driving into the ground for anchoring or supporting a structure. The ground anchor includes a hub with a helical load bearing plate and a pointed ground engaging end having a body with a spade point blade extending axially from the body and the hub. The blade has first and second opposing spiral major faces and first and second transverse minor spiral faces that converge at a flat axial face to form the blade with a spiral configuration. The blade has a longitudinal dimension extending at an inclined angle with respect to a longitudinal center axis of the ground anchor so that the axial face of the blade is spaced outwardly from the center axis of the ground anchor. The leading edge of the spiral blade directs the soil to the leading edge of the helical plate of the ground anchor.

19 Claims, 4 Drawing Sheets

BENT BLADE SCREW GROUND ANCHOR

FIELD OF THE INVENTION

The present invention is directed to a ground anchor having a blade extending axially from the ground anchor and a radially outwardly extending helical plate. The invention is particularly directed to a ground anchor having a ground engaging blade that is bent outwardly with respect to a longitudinal axis of the ground anchor and has a rotational twist or spiral.

BACKGROUND OF THE INVENTION

Ground anchors are commonly used to support various structures and for use by utilities for anchoring supports, utility poles, and the like. The anchors often have an elongated shaft with a square or round cross-section. A top end of the shaft has a drive connection for coupling to a rotating drive assembly. The bottom, ground engaging end has one or more helical outwardly extending load bearing plates fixed to a hub.

U.S. Pat. No. 4,981,000 to Hamilton et al. discloses an earth anchor having a helical plate and a flattened lead tip. The center of the lead tip as shown appears to be aligned with the center axis. The angle of the cutting edge is positioned such that the apex leads the point at the intersection between the second cutting edge and the helical blade to facilitate movement of the soil around the hub. FIG. 7 shows the face of the leading tip angled outwardly from the center axis and aligned with the leading edge of the helix.

One example of a screw anchor is disclosed in U.S. Pat. No. 4,334,392 to Dziedzic. This device is a modular screw anchor having an elongated rod with one or more specialized anchor members. The shaft also includes an obliquely oriented beveled earth penetrating lead to facilitate installation in rock soils. The anchor has a tubular, rod-receiving hub having a polygonal cross-section. An outwardly extending helical blade is fixed to the hub.

U.S. Pat. No. 5,408,788 to Hamilton et al. discloses a screw anchor having a hollow hub for receiving a wrench. A helical, load bearing element projects outwardly from the hub. An elongated, pointed spade extends from the end away from the hub. The spade has two diametrically opposed angular cutting margins on opposite sides of the hub.

U.S. Pat. No. 4,617,692 to Bond et al. discloses a drilling tip and expansion anchor for drilling a hole in a wall. The threaded shaft is rotated in a first direction to expand the anchor with a drill tip attached to the end of the shaft. The shaft is then rotated in the opposite direction to unscrew the shaft from the tip.

U.S. Pat. No. 4,750,571 to Geeting discloses a drilling apparatus having a disposable tip. A disposable cutting tip is attached to the auger section which is positioned within the ground screen. The tip is attached to the auger by a shear pin or bolt. The shear pin breaks when the auger is removed from the ground thereby leaving the drill tip in the ground.

U.S. Pat. No. 4,898,252 to Barr discloses a cutting tip for a rotary drill bit. The drill bit includes a wear surface attached to a plurality of plates forming the carrier for the cutting element. As the cutting edge wears, the plates break away to increase the clearance of the rear portion of the cutting edge and reducing the size of the wear surface to reduce the resistance to drilling.

U.S. Pat. No. 5,899,123 to Lukes discloses a threaded fastener having a drill point connected to the threaded fastener by a frangible line. The drill tip drills a hole through the work piece until the drill tip engages an inclined surface thereby causing the drill tip to break away from the threaded fastener.

U.S. Pat. No. 6,588,515 to Wentworth et al. discloses a rock drilling bit with a plurality of cutting teeth raked into the cut of the drilling bit. The teeth are angled at about 30° to provide the shear cutting force. The arrangement of the teeth reduces shock and vibration applied to the housing.

U.S. Pat. No. 7,182,556 to Takiguchi et al. discloses a drill with a disposable insert tip. The drill has a drill main body and an insert that is attached to the main body. The end of the main body has a plurality of guiding grooves shown in FIG. 2. The removable tip has convex portions that engage the guiding grooves. The drill does not have a frangible or break away portion.

U.S. Pat. No. 8,109,700 to Jordan et al. discloses a replaceable tip for a bit or auger. As shown in FIG. 1, the replaceable tip has a threaded shaft that is threaded into the threaded bore in the shaft of the auger. In the embodiment shown in FIG. 5, the auger has an end portion that is removably coupled to the shaft of the auger. The tip of the auger does not include a frangible portion.

While these prior devices have generally been suitable for their intended purpose, there is a continuing need in the industry for improved ground anchors.

SUMMARY OF THE INVENTION

The present invention is directed to a screw ground anchor and assembly for driving the ground anchor into the ground. The invention is particularly directed to a screw ground anchor having a ground engaging blade at a distal end of the ground anchor that extends along an axis formed at an incline with respect to the longitudinal axis of rotation of the ground anchor.

The ground anchor of the invention has a ground engaging end forming a pointed blade or spade tip that is able to stabilize the anchor and to penetrate the ground by a drive assembly in the ground. The ground anchor also includes a hub with a helical load bearing screw for supporting a load and/or for anchoring cables, guy wires or other structures. The ground engaging end with the pointed blade has angled faces that are able to penetrate the ground in various soil and rock conditions while directing the loosened soil directly to the helical plate.

Accordingly, one aspect of the invention is to provide a ground anchor that is able to penetrate the ground to support a load or anchor a structure where the ground anchor can be used in hard and soft soils. The blade at the ground engaging end of the ground anchor is oriented at an angle to assist in penetrating the ground and loosening the soil to allow the helical plate to penetrate the ground.

The invention is also directed to a ground anchor that can be used with a conventional driving apparatus without the need to modify the existing drive or drilling apparatus.

Another feature of the invention is to provide a ground anchor having a blade that can be used in soft and hard soils and is also able to efficiently penetrate the harder subsoil without the need to replace the drilling tip or to remove the assembly from the ground to change the assembly or anchoring members.

The screw ground anchor assembly of the invention has a hub with a load bearing helical screw plate and a ground engaging blade end that is able to penetrate the ground to assist in driving the load bearing screw into the ground to a depth necessary to support the desired load or anchor the intended structure.

The ground anchor of the invention has a blade extending axially from the hub where the blade has inclined side faces that converge to a tip forming a ground engaging axial face. The axial face can have a blunt, flat surface extending substantially perpendicular to a longitudinal axis of the ground anchor. In one embodiment, the blade has at least two opposing spiral major faces that converge toward the axial face at an inclined angle with respect to the longitudinal axis of the ground anchor. The base portion of the blade has a substantially trapezoidal shape while the axial face has a substantially rectangular shape.

The side faces of the blade preferably have a spiral curvature that occurs in the direction of rotation of the ground anchor when driven into the ground. The spiral surface forms the blade with a twisting, spiral configuration. The leading cutting edge of the blade is oriented in front of the leading edge of the helical plate to direct the loosened soil toward the leading edge of the helical plate. The leading cutting edge extends in a spiral from the ground engaging axial face of the blade to a point above and forward of the leading edge of the helical plate.

The side faces of the blade are twisted and spiral in an axial and longitudinal direction with respect to the blade to provide the blade with a spiral shape that complements the spiral of the helical plate. The spiral side faces extend in a longitudinal direction with respect to a longitudinal axis of the blade. The longitudinal axis of the blade preferably is oriented at an incline with respect to the longitudinal center axis of the ground anchor which defines the axis of rotation of the ground anchor. The major side faces of the blade spiral about 25° to about 35° and typically about 30° along the longitudinal length of the blade between a respective edge at a base portion of the blade and side edge of the axial face. The side edges of the axial face along the major faces of the blade are rotated about 25°-35° and typically about 30° from the corresponding bottom edge of the major faces at the base portion of the blade in a direction of rotation of the ground anchor when penetrating the ground.

In one embodiment of the invention, the blade has a base portion coupled to the body of the ground anchor with a substantially trapezoidal shape and an outer axial face with a substantially rectangular shape. The distal edges of the side faces are not parallel to the edges of the base portion of the blade to form the spiral shaped side surfaces. In one embodiment, the distal edges of the major side faces are at an angle of about 30° with respect to the respective edge at the base portion of the blade. The longitudinal axis of the blade is oriented at an angle of about 15°-25° and preferably about 20° from the longitudinal center axis of the ground anchor and the axis of rotation of the ground anchor.

These and other aspects of the invention are basically attained by providing a ground anchor comprising a body having a top face and a ground engaging bottom face and a center longitudinal axis defining an axis of rotation of the ground anchor. A blade extends from the bottom face of the body. The blade has a first major face, a second major face opposite the first major face, a first minor face extending between the first and second major faces, and a second minor face extending between the first and second major faces. Each of the major faces and minor faces converge to a ground engaging axial face. The blade has a longitudinal center axis extending from a base of the blade to the axial face and is oriented at an inclined angle with respect to the longitudinal axis of the body to orient at least a portion of the axial face radially outward from the first and second major faces with respect to the center longitudinal axis.

The various features and advantages of the invention are also attained by providing a ground anchor comprising a hub having a ground engaging helical plate with a leading edge for penetrating the ground and a trailing edge. The helical plate has a dimension for supporting a load in the ground. A body having a top face is coupled to the hub and has a ground engaging bottom face. The body has a center longitudinal axis extending through the ground anchor. A blade extends from the bottom face of the body where the blade has a base portion with a center axis aligned with the center axis of the body and a plurality of spiraling side surfaces converge into a ground engaging axial face. The blade has a longitudinal axis extending at an incline with respect to the longitudinal axis of the body.

The objects and advantages of the invention are further attained by providing a ground anchor comprising a body having a top face with a shaft for coupling with a rotary drive and a ground engaging bottom face. The body has a center longitudinal axis extending through the ground anchor defining an axis of rotation of the ground anchor. A ground engaging blade extends from the bottom face of the body. The blade has a plurality of spiraling surfaces that converge into a ground engaging substantially flat axial face. The blade has a longitudinal center axis extending between the center axis of the body and a center of the axial face where the longitudinal axis of the blade extends at an inclined angle with respect to the longitudinal axis of the body. The axial face has an outermost edge that is substantially axially aligned with an outer edge of the body.

The various objects, advantages and salient features of the invention will become apparent from the annexed drawings and detailed description of the invention which form part of the original disclosure.

BRIEF DESCRIPTION OF THE DRAWINGS

The following is a brief description of the drawings, in which.

DETAILED DESCRIPTION OF THE INVENTION

Figure 1:
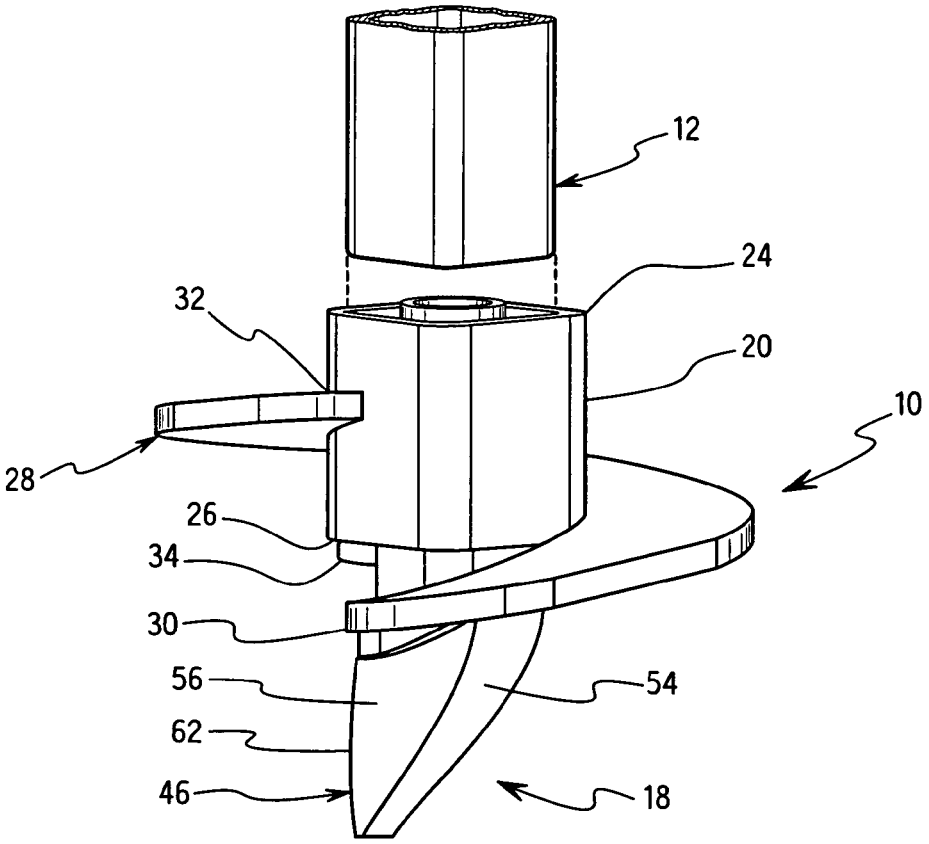
FIG. 1 is an exploded perspective view of the ground anchor and a drive assembly for installing the ground anchor into the ground.
Figure 2:
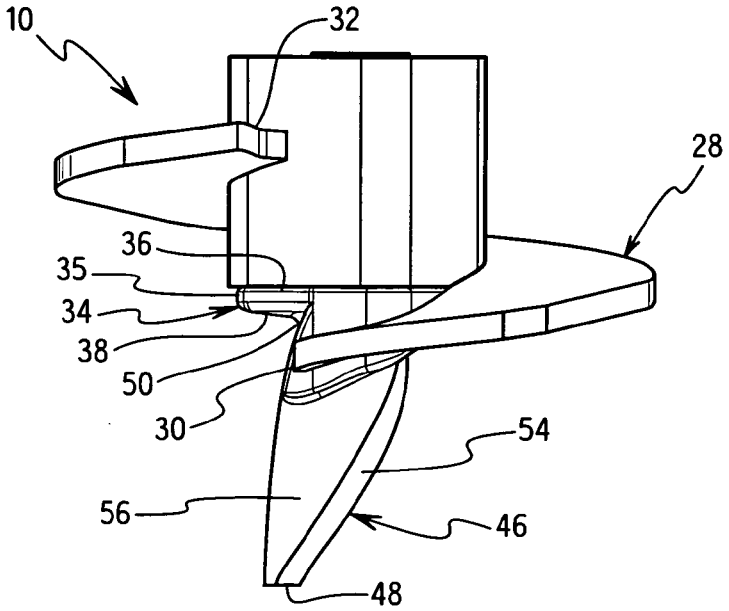
FIG. 2 is a front view of the ground anchor showing the angle of the blade in relation to the helical plate.

The present invention is directed to a spade point screw ground anchor for penetrating the ground for anchoring or supporting a structure. As shown in FIGS. 1 and 2, the ground anchor 10 is driven into the ground to a selected depth using a commercially available drilling apparatus. The drilling apparatus in the embodiment shown includes a drive member having a square cross-section for mating with the ground anchor 10. Once the ground anchor is driven into the ground, the drive member 12 is removed as shown in FIG. 1. An anchoring rod is coupled to the ground anchor and is connected to a support or to a guy wire for anchoring the intended structure. Examples of drilling apparatus and anchoring assemblies are disclosed in U.S. Pat. Nos. 4,334,392, 5,408,788 and 5,575,122, which are hereby incorporated by reference in their entirety.

Referring to the drawings, the ground anchor 10 includes a ground engaging spade point lead 18 and a hub 20. The lead 18 and hub 20 are coupled together as shown in FIGS. 1-10 by welding. The hub 20 as shown has a substantially square cross-section in the illustrated embodiment with a hollow interior for receiving the drive member 12. The hub 20 has a top end 24 for mating with the drive member 12 and a bottom end 26 coupled to the ground engaging lead 18. As shown in FIGS. 1 and 2, a helical screw plate 28 is fixed to the outer face of the hub 20 for penetrating the ground and anchoring and/or supporting the structure. The helical screw plate 28 has a dimension sufficient to anchor and support the desired structure. In one embodiment, the helical screw has a leading edge 30 that is coupled to a portion of the ground engaging lead 18 and a trailing edge 32 towards the top end 24 of the hub 20.

Figure 4:
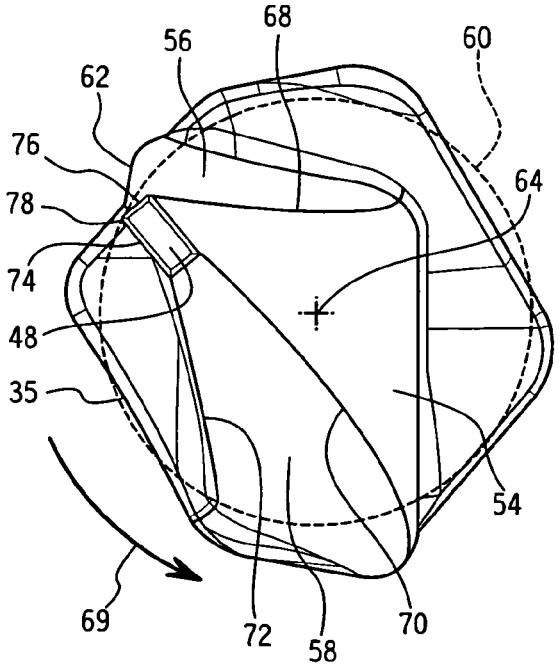
FIG. 4 is a bottom end view of the screw ground anchor of FIG. 3.

The ground engaging lead 18 of the ground anchor 10 has a body portion 34 with a top face 36 and bottom face 38. The top face 36 of body portion 34 includes a shaft 40 extending axially in an upward direction as shown in FIG. 4. The shaft 40 has a substantially cylindrical shape with an axial bore as known in art. The axial bore is typically provided with internal threads for mating with the anchor rod or support structure.

Figure 3:
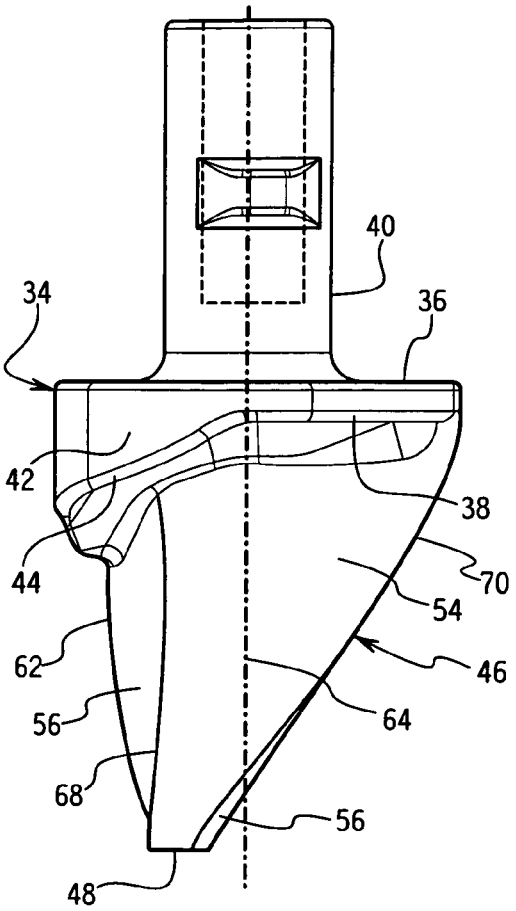
FIG. 3 is a side view of the screw ground anchor in one embodiment separated from the hub and helical plate.

As shown in FIGS. 1 and 2, the body 34 has an outer dimension corresponding substantially to the dimension of the hub 20 and is coupled to the hub 20 by suitable means such as welding. The body 34 has a flight portion 42 that spirals downward from the top face 36 along a radial section of the top edge of the body. As shown in FIG. 3 the flight portion 42 forms the outer surface of the lead 18 for supporting the leading edge of the helical plate 28. The flight 42 has an inclined bottom surface 44 for guiding loosened soil upwardly towards the helical plate during rotation of the ground anchor. As shown in the drawings, the leading end of the helical plate 28 extends past the bottom face 38 of the hub 22 along the flight portion 42. The leading edge of the helical plate is fixed to the outer radial face of the flight portion 42 typically by welding.

A ground engaging blade 46 extends axially from the bottom face 38 of the body 34. As shown in the drawings, blade 46 has tapered sides that converge to an axial end face 48 at a bottom or distal end of the blade 46. A base portion 50 at a top end defining a proximal end of the blade 46 is integrally formed with the body 34.

Blade 46 has a first major face 52 and a second opposing major face 54 that converge toward the axial end face 48. A first minor face 56 and a second minor face 58 converge to the axial end face 48. The first minor face 56 extends between the first major face 52 and the second major face 54 and along a first side edge of the major faces. The second minor face also extends between the first major face 52 and the second major face 54 along an opposite side edge of the major faces. Each of the major faces and minor faces define a spiral surface extending along the longitudinal axis of the blade 46 so that the blade 46 has a twisted or spiral configuration for penetrating the ground. The axial end face 48 typically has a flat surface lying in a plane perpendicular to the longitudinal axis of the ground anchor and the body. In the embodiment shown, the axial end face 48 has a substantially rectangular configuration defined by the bottom edges of the major faces 52 and 54 and minor faces 56 and 58.

Figure 5:
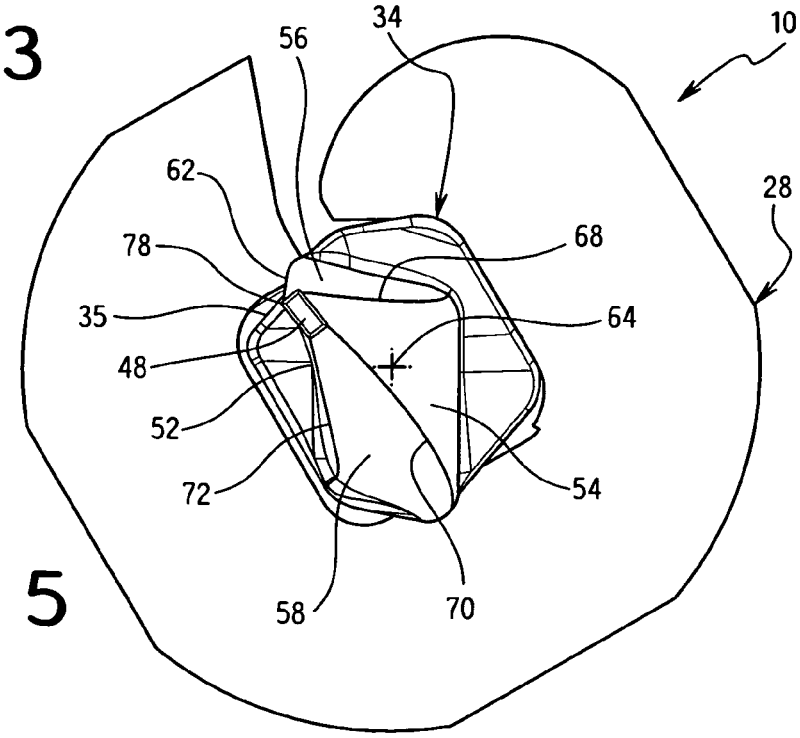
FIG. 5 is an end view of the screw ground anchor and helical plate.

The blade 46 has a substantially trapezoidal shaped cross-section at a base portion 50 of the blade joining the body 34. As shown in the embodiment of FIG. 5, the base portion 50 is substantially centered with the longitudinal center axis 64 The first major face 52 and second major face 54 are inclined with respect to each other and the first minor face 56 and second minor face 58 are inclined with respect to each other. The first and second minor faces are also formed at an incline with respect to the first and second major faces. As shown in the drawings, each of the faces of the blade converges from the substantially trapezoidal shaped base portion 50 to the substantially rectangular shaped axial end face 48.

Figure 7:
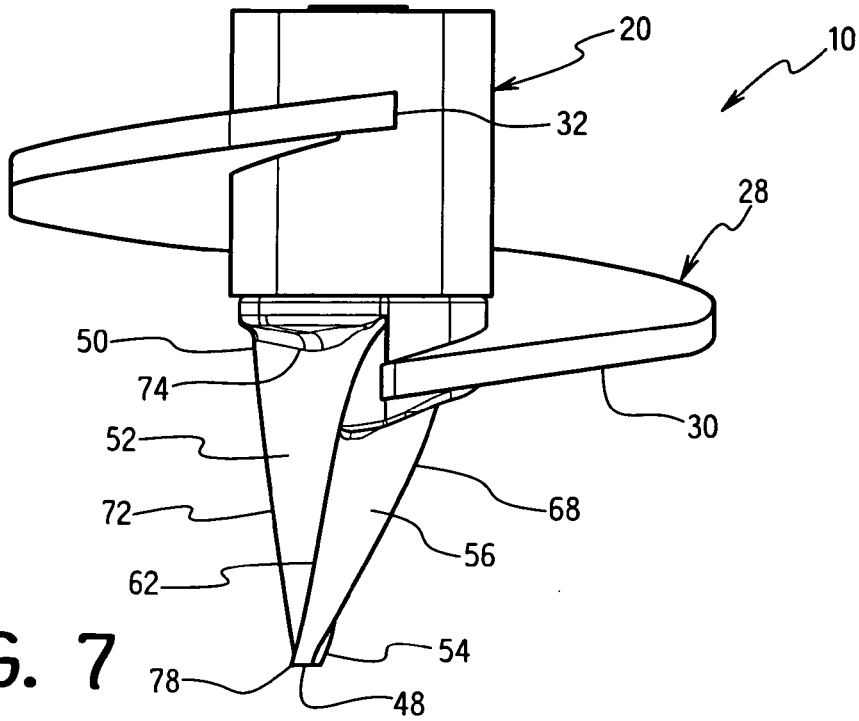
FIG. 7 is a side view of the screw ground anchor taken from the left of FIG. 6.
Figure 8:
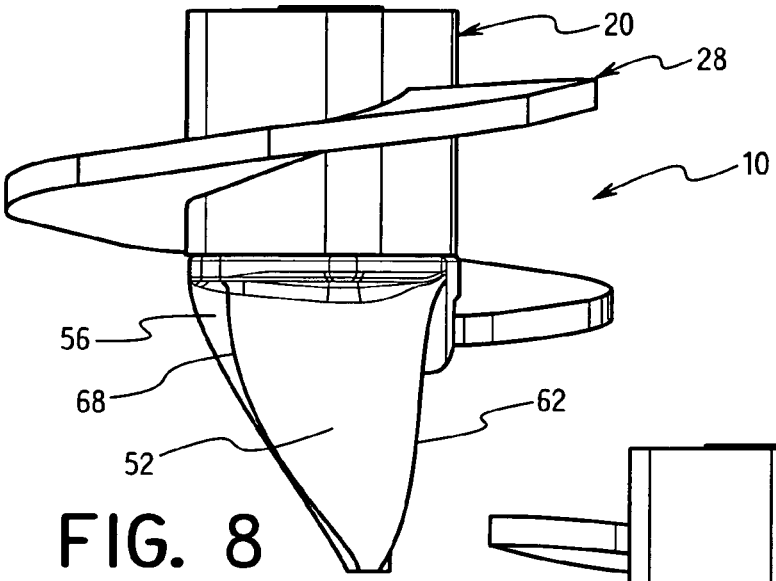
FIG. 8 is a side view of the screw ground anchor of FIG. 6.

The first major face 52 and the first minor face 56 converge to form a leading cutting edge 62. The leading cutting edge 62 has a curved spiral shape extending from the base portion 50 of the blade 46 to the axial face 48. The leading cutting edge 62 defines the radially outermost edge of the blade 46. In the embodiment shown, the first major face 52 is inclined at an angle extending radially away from the center axis 64. As shown in the drawings, the leading cutting edge 62 and the first major face 52 extend above the top surface of the leading edge 30 of the helical plate 28. In a preferred embodiment, the entire cutting edge 62 and the first major face 52 are oriented in front of the leading edge 30 of the helical plate as shown in FIG. 7.

Figure 6:
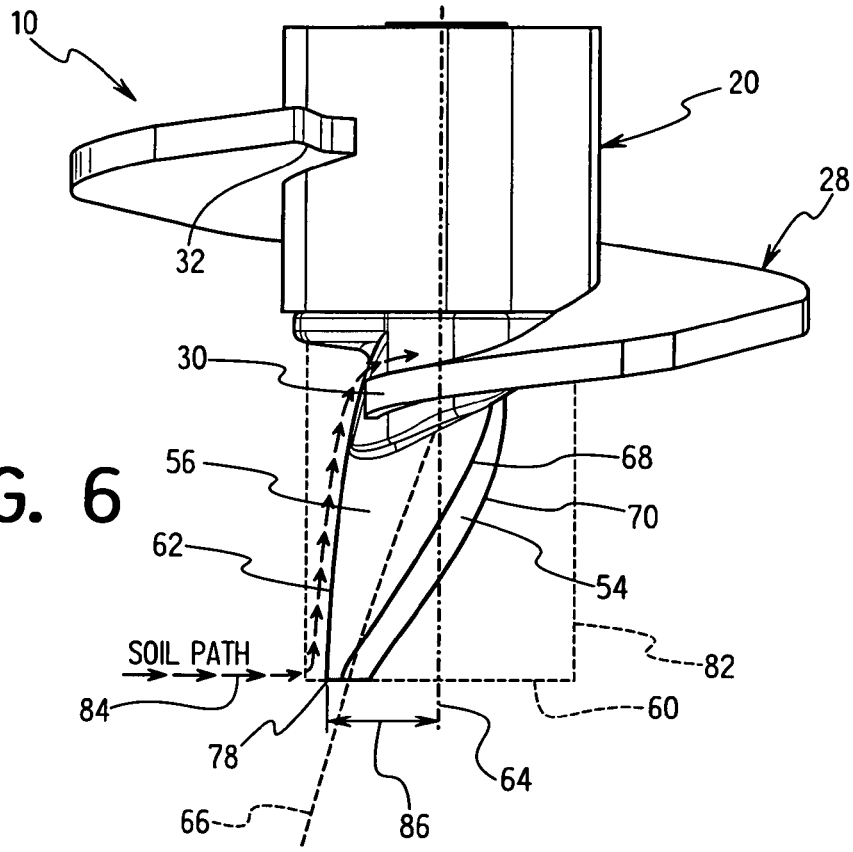
FIG. 6 is a front view of the ground anchor showing the path of the loosened soil along the surfaces of the blade and the helical plate.

The body 34 has a central longitudinal axis 64 that extends through the central axis of the hub 20 and the longitudinal axis of the ground anchor 10. The axis 64 corresponds to the longitudinal axis of rotation of the ground anchor 10 when the ground anchor it is driven into the ground. The blade 46 has a longitudinal axis 66 that extends at an inclined angle with respect to the longitudinal axis 64 of the ground anchor 10 so that the blade 46 extends in a radially outward and axial direction with respect to the body 34 and the longitudinal axis 64. The longitudinal axis 66 of the blade 46 intersects with the longitudinal axis 64 as depicted in FIG. 6.

In the embodiment shown, the axial end face 48 of the blade 46 has a substantially flat surface extending in a plane substantially perpendicular to the center axis 64 to form a blunt end face. As shown in FIGS. 1 and 2, the blade 46 is oriented on the body portion 34 such that the base portion 50 is positioned substantially in the center of the body portion 34. The axial end face 48 is off-center and radially spaced from the center axis 64 such that the cutting edge of the blade 46 is spaced radially outward of the center longitudinal axis. The axial end face 48 rotates about the center axis in a circular path during rotation of the ground anchor 10 as depicted by line 60 in FIG. 4. The axial end 48 has a surface area and dimension that is able to penetrate the soil during the initial phase of the installation of the ground anchor in the ground and to allow the blade 46 to penetrate the ground and prevent the ground anchor from moving or walking from the intended penetration site until the helical plate of the ground anchor is able to penetrate the ground. The axial face 48 is spaced radially outward from the center axis 64 so that the outermost edge of the axial end face is substantially aligned with the radial outer edge 35 of the body 34 so that the blade 46 and the axial face 48 loosen the soil in a path corresponding substantially to the diameter of the body 34 as depicted by line 82 in FIG. 6.

In the embodiment shown, each of the contiguous spiral faces of the blade 46 form a spiral edge between the faces. As shown in the drawings, the first minor face 56 joins the second major face 54 to define a spiral edge 68 that trails the leading cutting edge 62 with respect to the direction of rotation of the ground anchor 10 indicated by arrow 69 in FIG. 4. The second major face 54 joins the second minor face 58 to define a spiral edge 70. The second major face 58 joins the first major face 52 to define a spiral edge 72. As shown in FIG. 6, the spiral edge 72 is spaced radially inward of the leading cutting edge 62 with respect to the direction of rotation of the ground anchor during installation in the ground.

The blade 46 is oriented with its longitudinal axis 66 at an inclined angle with respect to the longitudinal axis 64 of the ground anchor and body so that the leading cutting edge 62 and axial face 48 travel in the circular path 60 spaced radially outward from the longitudinal center axis 64. The blade 46 can be oriented with the longitudinal axis of the blade intersecting with the center longitudinal axis and oriented at an angle of about 15° to 25° and preferably about 20° with respect to the longitudinal center axis 64. In the embodiment shown in FIG. 6, the blade 46 is oriented with the longitudinal axis 66 at about 20° to the longitudinal center axis 64 and has a length so that the leading cutting edge 62 and the outer corner of the axial face 48 define a radius 86 as shown in FIG. 6 from the rotational axis 64 corresponding substantially to the average radius of the body 34.

In one preferred embodiment, the leading cutting edge 62 forms the circular cutting path 60 so that at least a portion of the circular cutting path 60 is spaced radially outward from an outer edge 35 of the body 34 as shown in FIG. 5. The first major face 52 forms an edge 74 of the axial face 48 and the first minor face 56 forms an edge 76 at the axial face 48 to define a leading corner cutting edge 78 of the axial face 48. The corner 78 defines the cutting edge of the axial face 48 and defines a point that is spaced on the radius 86 furthest from the longitudinal center axis 64 and forms the cutting circle indicated by dotted lines 60 shown in FIG. 4. As shown in FIG. 4, the leading corner cutting edge 78 of the axial face 48 is axially aligned with the outer edges of the body 34 to loosen the soil in an area substantially equal to the area of the body 34 to assist in the helical plate 28 penetrating the ground. In one embodiment, the leading corner cutting edge 78 is spaced radially outward from the first major face 52 and the first minor face 56. Preferably, at least a portion of the axial face is oriented radially outward from the first major face and the second major face with respect to the center longitudinal axis 64 of the body 34.

The first and second major faces 52 and 54 spiral about 25° to about 35° along the longitudinal dimension of the respective face of the blade 46. The first major face 52 forms a first edge 74 at the axial face 48 and the second major face 54 forms a second edge 90 at the axial face 48. The first edge 74 and second edge 90 are substantially parallel to each other and form an angle of about 25°-35° with respect to the corresponding bottom edge of the respective face at the base 50 of the blade 46. In the embodiment shown, the edges 74 and 90 of the axial face 48 are at an angle of about 30° with respect to the bottom edge of the respective face at the base 50 of the blade. The minor faces 56 and 58 spiral in a similar manner between the bottom edge of the respective face at the base 50. The respective edges 76 and 94 of the axial face 48 are angled at about 50°-70° with respect to the bottom edge of the respective face. In the embodiment shown, the edges 76 and 94 are at an angle of about 60° with respect to the respective bottom edge of the respective face at the base of the blade 46.

Figure 9:
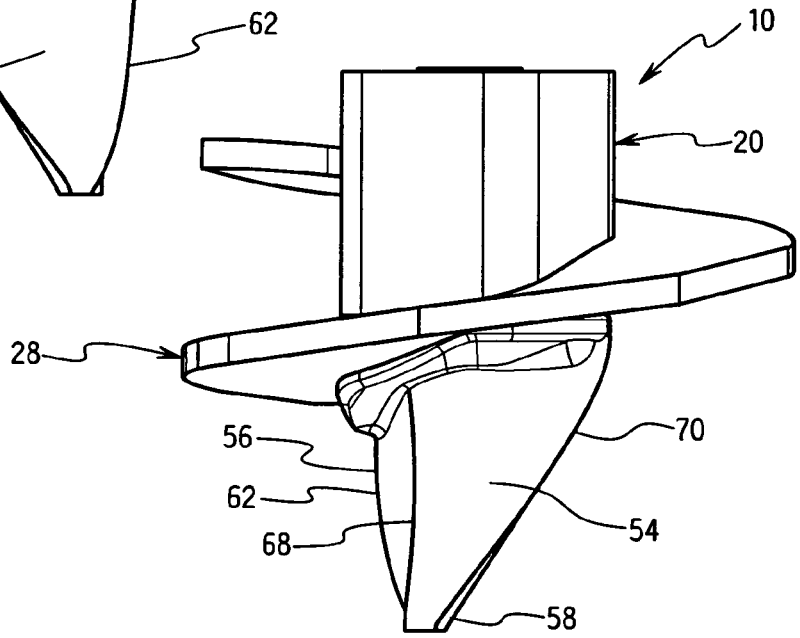
FIG. 9 is a right side view of the screw ground anchor of FIG. 6.
Figure 10:
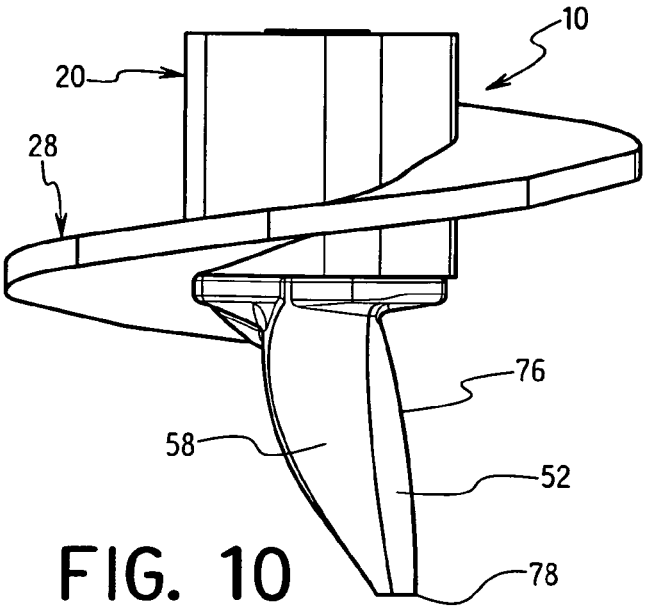
FIG. 10 is a back side view of the screw ground anchor of FIG. 6.

As shown in FIG. 5 and FIG. 6, the incline of the longitudinal axis 66 of the blade 46 and the axial length of the blade position the leading corner cutting edge 78 radially outward from the top edge of the first major face 52 with respect to the central longitudinal axis 64. The first major face 52 is inclined radially outward with respect to the center longitudinal axis 64 and inclined outward with respect to the base portion 50 at the top edge of the first major face 52. The leading cutting edge 62 extends in a spiral orientation in a generally axial direction and at an inclined angle extending radially outward from the first major face 52 so that the leading corner cutting edge 78 of the axial face 48 is oriented radially outward from the first major face 52. As shown in FIG. 2 and FIG. 9, the leading cutting edge 62 curves from the base portion 50 of the blade 46 radially outward to the axial face 48 so that the corner of the axial face 48 is spaced radially outward from the base portion 50 of the blade 46.

During use, the ground anchor 10 is connected to a rotary drive assembly as in the previous embodiment and driven into the ground by the rotational driving force of the drive apparatus. The blunt axial end 48 initially penetrates the soil at the surface for driving the ground anchor 10 into the ground. As the ground anchor 10 is driven into the ground, the spiral faces of the blade direct the soil toward the helical plate 28. The helical plate 28 penetrates the ground to a desired depth for anchoring or stabilizing the intended structure. The blade 48 is oriented with the body 34 and the helical plate 28 so that the leading cutting edge 62 and the first major face 52 are inclined to direct the soil upwards along a major face 52 to the leading edge of the helical plate 28 as indicated by lines 84 in FIG. 6. As shown in FIG. 6, the leading cutting edge 62 and the first major face 52 extends above the top face of the helical plate 28 at the leading edge. The blade 46 is angled with the axial face 48 forward of the leading edge 30 with respect to a direction of rotation of the ground anchor 10 to feed the loosened soil toward the helical plate.

While various embodiments have been chosen to illustrate the invention, it will be understood by those skilled in the art that various changes and modifications can be made without departing from the spirit and scope of the invention as defined in the appended claims.

What is claimed is:

1. A ground anchor comprising:

a body having a top face and a ground engaging bottom face, said body having a center longitudinal axis; and a blade extending from said bottom face, said blade having a first major face, a second major face opposite said first major face, a first minor face extending between said first and second major faces, and a second minor face extending between said first and second major faces;

each of said major faces and minor faces defining spiral surfaces converging to a ground engaging axial face, said blade having a longitudinal center axis extending from a base portion of said blade to said axial face, said longitudinal center axis of said blade being oriented at an incline with respect to said center longitudinal axis of said body, at least a portion of the axial face being oriented radially outward of said first and second minor faces and first and second major faces with respect to said center longitudinal axis of said body.

2. The ground anchor of claim 1, wherein at least one of said major or minor faces is inclined at an angle and extends radially away from said central axis of said body.

3. The ground anchor of claim 1, wherein said axial face forms a planar surface oriented in a plane substantially perpendicular to said center longitudinal axis of said body.

4. The ground anchor of claim 3, wherein each of said major faces and each of said minor faces have a bottom edge at a base portion and an outer edge at said axial face, and each of said outer edges being oriented at an inclined angle with respect to the bottom edge of each of said major faces and minor faces at said base portion.

5. The ground anchor of claim 4, wherein said first major surface is contiguous with said first minor surface to form a first longitudinal edge defining a leading cutting edge of said blade, said first longitudinal leading edge extending in a spiral path between said base portion and said axial face.

6. The ground anchor of claim 5, further comprising a hub coupled to said top face of said body and a helical anchor plate coupled to said hub;

said helical anchor plate having a leading edge and a trailing edge, and where said first major face and said first longitudinal edge of said blade are positioned forward of said leading edge of said helical anchor plate with respect to a direction of rotation of said ground anchor.

7. The ground anchor of claim 6, wherein said first major face and first leading cutting edge have a top end positioned above a top surface of said leading edge of said helical anchor plate.

8. The ground anchor of claim 7, wherein said first leading cutting edge and said outer edge of said first major face are position forward of said leading edge of said helical anchor plate with respect to a direction of rotation of said ground anchor.

9. A ground anchor comprising;

a hub having a ground engaging helical anchor plate with a leading edge for penetrating the ground and a trailing edge, said helical anchor plate having a dimension for supporting a load;

a body having a top face coupled to said hub and a ground engaging bottom face, said body having a center longitudinal axis extending through said ground anchor; and a blade extending from said bottom face of said body, said blade having a base portion with a center axis aligned with said center axis of said body, a first major face and a first minor face defining spiral side faces converging to a ground engaging axial face, said blade having a longitudinal axis extending at an inclined angle with respect to said longitudinal axis of said body, and said first major face and said first minor face define a corner of said axial face, said corner being spaced radially outwardly from a portion of a bottom edge of said first major face;

said first minor face extending between said first major face and a second major face, said first major face at said first minor face converging to form a spiral leading cutting edge; and a second minor face opposite said first minor face and extending between said first major face and second major face;

said first major face is inclined at an angle with respect to said bottom face of said body to extend radially outward with respect to said center longitudinal axis of said body; and said second major face is inclined at an angle with respect to said bottom face of said body to extend radially inward from a base of said second major face with respect to said center longitudinal axis of said body.

10. The ground anchor of claim 9, wherein said first major face has an inner edge at said bottom side of said body, and said second major face has an inner edge at said bottom side of said body, said inner edges of said first and second major faces being substantially parallel;

said first major face has an outer edge at said axial face and said second major face has an outer edge at said axial face, said outer edges of said first and second major faces being oriented at an inclined angle to the respective inner edge.

11. The ground anchor of claim 9, wherein said first major face and said leading cutting edge are oriented forward of said leading edge of said helical plate with respect to a direction of rotation of said ground anchor.

12. The ground anchor of claim 11, wherein said first major face and leading cutting edge have a top end extending above said leading edge of said helical plate.

13. The ground anchor of claim 12, wherein said corner of said axial face between said first major face and said first minor face is positioned forward of said leading edge of said helical anchor plate with respect to a direction of rotation of said ground.

14. A ground anchor comprising:

a body having a top face with a shaft for coupling with a rotary drive, and a ground engaging bottom face, said body having a longitudinal axis extending through said ground anchor; and a ground engaging blade extending from said bottom face of said body, said blade having a first major face and first minor face defining spiraling faces converging to a ground engaging substantially flat axial face, said blade having a longitudinal axis extending between said longitudinal axis of said body and a center of said axial face, said longitudinal axis of said blade extending at an inclined angle with respect to said longitudinal axis of said body, said axial face having a corner defined by said first major face and said first minor face, where a longitudinal end of said corner is substantially axially aligned with an outer edge of said body.

15. The ground anchor of claim 14, further comprising a hub coupled to said top face of said body; and a ground engaging helical plate coupled to and extending radially outward from said hub, said helical plate having a leading edge and a trailing edge;

said first major face has a first spiral surface extending between said base and said axial face, and said first minor face has a spiral surface extending between said base and said axial face, said first major face and said second minor face converging to form a leading spiral cutting edge, said first major face and cutting edge being oriented forward of said leading edge of said helical plate with respect to a direction of rotation of said ground anchor.

16. The ground anchor of claim 15, wherein said first major face is oriented to feed soil directly to said leading edge of said helical plate by rotation of said ground anchor.

17. The ground anchor of claim 16, wherein said first major face and said cutting edge extends above said leading edge of said helical plate.

18. The ground anchor of claim 17, wherein said axial face has a substantially rectangular shape, said first major face defines a spiral surface extending from an inner edge at said ground engaging bottom face of said body to an outer edge at said axial face, said outer edge of said first major face being oriented at an inclined angle with respect to said inner edge of said first major face.

19. The ground anchor of claim 18, wherein said first major face extends outwardly in a radial direction at an incline with respect to said longitudinal axis of said body, and said blade has a second spiral major face opposite said first major face, said second major face having an end portion extending outwardly at an inclined angle with respect to said longitudinal axis of said body.

* * * * *